US008387171B2

(12) United States Patent
Farber et al.

(10) Patent No.: US 8,387,171 B2
(45) Date of Patent: Mar. 5, 2013

(54) MICROFLUSH URINAL WITH OSCILLATING NOZZLE

(75) Inventors: Jason Farber, East Brunswick, NJ (US); Alan Romack, Columbia, MD (US); Greg Russell, Catonsville, MD (US); Aland Santamarina, Columbia, MD (US); Keith Schloer, Owings Mills, MD (US); Steven Crockett, Hampstead, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 1132 days.

(21) Appl. No.: 11/686,104

(22) Filed: Mar. 14, 2007
(Under 37 CFR 1.47)

(65) Prior Publication Data

US 2008/0216222 A1 Sep. 11, 2008

Related U.S. Application Data

(60) Provisional application No. 60/792,122, filed on Apr. 14, 2006.

(51) Int. Cl.
*E03D 13/00* (2006.01)
*E03D 1/00* (2006.01)
*B05B 1/08* (2006.01)

(52) U.S. Cl. ..... 4/305; 4/301; 4/302; 4/313; 239/589.1

(58) Field of Classification Search ..... 4/300.3, 4/301, 302, 305, 310, 311, 313, DIG. 3, DIG. 5; 239/589.1
See application file for complete search history.

(56) References Cited

U.S. PATENT DOCUMENTS

| | | | | |
|---|---|---|---|---|
| 4,309,781 | A * | 1/1982 | Lissau | 4/304 |
| 4,692,951 | A * | 9/1987 | Taki et al. | 4/664 |
| 4,805,247 | A * | 2/1989 | Laverty, Jr. | 4/304 |
| 5,313,673 | A * | 5/1994 | Saadi et al. | 4/313 |
| 5,398,348 | A * | 3/1995 | Tashiro et al. | 4/304 |
| 5,845,845 | A | 12/1998 | Merke et al. | |
| 6,186,409 | B1 | 2/2001 | Srinath et al. | |
| 6,253,782 | B1 | 7/2001 | Raghu | |
| 6,862,754 | B1 * | 3/2005 | DeMarco | 4/304 |
| 6,978,951 | B1 * | 12/2005 | Raghu | 239/589.1 |
| 2001/0019086 | A1 | 9/2001 | Srinath et al. | |
| 2005/0087633 | A1 | 4/2005 | Gopalan | |

OTHER PUBLICATIONS

Suzanne Gannon, "For the High-End Bathroom, Something Unexpected", New York Times, Jan. 25, 2007.
Kohler Bardon Touchless Urinal Spec Sheet, www.us.kohler.com/onlinecatalog/detail.jsp?prod_num=4915, website registered in 1994.

(Continued)

*Primary Examiner* — Ryan Reis
(74) *Attorney, Agent, or Firm* — J. Andrew McKinney, Jr.

(57) ABSTRACT

The present invention is directed to a microflush urinal that includes a piece of chinaware in fluid communication with a pre-existing water supply and a waste removal conduit. A valve means in electrical communication with each of a sensor means and a fluid manifold effects delivery of incoming fluid to a water delivery means. The water delivery means is desirably a nozzle means selected from one of a plurality of fluidic nozzles that delivers pressurized water through an ingress defined in a rear wall of the chinaware. The nozzle desirably oscillates water for full coverage of the urinal's rear and side walls. A tarp portion that aesthetically obstructs the ingress assumes a generally scalloped shape to optimize the water distribution along the urinal's rear and side walls. At least one trough is integrated into one or more urinal sidewalls to guide water from the nozzle toward the waste removal conduit.

17 Claims, 3 Drawing Sheets

OTHER PUBLICATIONS

Duravit Architec Utronic Electronic Urinal Spec Sheet, www.plumbersurplus.com/Prod/Duravit-Architec-Utronic-Electronic-Urinal, website registered in 1999.

Villeroy & Boch Collection Subway Siphonic Urinal product sheet, www.villeroy-boch.com, website registered in 1997.

* cited by examiner

MICROFLUSH URINAL WITH OSCILLATING NOZZLE

This application claims the benefit of priority of co-owned U.S. Ser. No. 60/792,122, filed Apr. 14, 2006.

FIELD OF THE INVENTION

The present invention is directed to sanitaryware that consumes minimal water volume yet achieves optimal hygiene standards. More particularly, the present invention is directed to a urinal having an oscillating water delivery means that substantially improves sanitation along a urinal wall without increasing water volume. In this configuration, the present invention urinal achieves optimum water conservation in concert with enhanced urinal cleanliness.

BACKGROUND OF THE INVENTION

The excessive consumption of potable water remains a dilemma for water agencies, commercial building owners, homeowners, residents and sanitaryware manufacturers. An increasing global population has negatively affected the amount and quality of suitable water. Effluents in water supplies and increasing air pollutants have drastically altered fresh water supplies. The propensity for drought in previously fertile geographies has reinforced global concern over responsible water consumption. The drive for optimum water conservation strategies, however, typically yields to the overriding need to sustain a healthy population through the enactment and enforcement of plumbing codes and the installation of sanitary plumbing fixtures that are compliant therewith.

In an effort to execute water conservation strategies, many sanitaryware manufacturers have introduced a variety of low water and water-free urinals. Waterless urinals are available that often employ replaceable cartridges. The cartridges have means for entry and discharge and a sealant layer that prevents malodorous emissions from the drainage system yet allows flow of urine therethrough. Conventional waterless designs, however, do not scour a back wall surface and do not provide a water trap seal as required by plumbing codes in the United States and other jurisdictions. In addition, omission of the water trap seal in waterless fixtures necessarily omits replenishment of the trap seal after each use, thereby requiring frequent maintenance of the fixtures to maintain satisfactory cleanliness (such as the addition of a liquid medium to provide a seal between the liquid waste and the room, and periodic cartridge replacement). Examples of such devices are disclosed in U.S. Pat. Nos. 6,053,197, 6,425,411, 5,711,037 and US Patent Application Nos. 2002/0069913 and 2002/0038474.

In addition, many conventional low-water urinals have strategically designed bowls and trapways that restrict elimination of water from the bowl during flushing (see, for example, U.S. Pat. Nos. 4,310,934 and 5,386,596). Such designs, however, still use an inordinate amount of water to complete a flush cycle, especially in consideration of contemporary water conservation efforts. Other well-known conventional designs use a manifold with integral holes at the top of the urinal to distribute water around the inside top perimeter. The manifold comprises an additional chinaware piece in the construction of the urinal, thereby increasing manufacturability efforts and costs. Such manifolds do not produce a uniform distribution and typically are not pressurized; such devices employ a "gravity fed" technique that and trickles down the sides of the urinal at low velocity along a uniform path. Such configurations exhibit disadvantageous hygiene limitations by omitting fluid coverage over the entirety of the urinal's waste receiving surface.

Other manufacturers have used sensor means to release water at predetermined intervals, thereby providing a dual or multi-flush urinal for maintenance of sanitary conditions with minimal water consumption. For instance, U.S. Pat. No. 6,862,754 to DeMarco ("DeMarco") discloses a dual-phase flush urinal comprising a chinaware piece in combination with a valve means (DeMarco is owned by American Standard International Inc., co-owner of the present application, and is incorporated by reference herein). The valve means is in electrical communication with a sensor that detects the presence of a user and has first and second fluid discharge ports, wherein the first fluid discharge port is in fluid communication with a bowl portion defined in the chinaware. Upon detection of the user, the sensor transmits a first signal to the valve means to initiate a first water exchange phase of the flush cycle. The first fluid discharge port provides water along an elongate channel to remove waste from the bowl portion. After a preprogrammed delay, the sensor transmits a second signal to the valve means to initiate a subsequent, time-delayed wall-scouring phase of the flush cycle. The second fluid discharge port provides water through a urinal spreader to ensure rinsing of the back surface subsequent to actuation of the jet. The valve means operates according to a desired preprogrammed schedule to ensure delivery of adequate water to the urinal jet and expulsion of waste from the urinal to an exterior sewage system.

It is therefore desirable to provide a urinal that substantially reduces consumption of portable water without comprising sanitation. Such a urinal uses minimal water amounts to achieve an effective, repeatable flush and thereby maintain optimal fixture cleanliness.

SUMMARY OF THE INVENTION

It is an advantage of the present invention to provide an improved urinal that consumes substantially less water than conventional flush urinals.

It is also an advantage of the present invention to provide a urinal that overcomes the deficiencies of waterless urinals by providing a code-compliant fixture that scours itself with water to ensure cleanliness and odor-free operation.

It is still further an advantage of the present invention to provide a urinal having the aforementioned advantages that can assume the appearance and proportions of conventional urinals for simple installation and maintenance in existing sanitary facilities.

In accordance with these and other advantages, the present invention is directed to a microflush urinal that employs an oscillating water delivery means for scouring back and side walls of a urinal and moving residue therefrom. The urinal of the present invention includes a piece of chinaware that is in fluid communication with each of a pre-existing water supply and a waste removal conduit. A valve means is provided in electrical communication with each of a sensor means and a fluid manifold for delivery of incoming fluid to a nozzle means. The water delivery means is desirably a nozzle means selected from one of a plurality of fluidic nozzles. The nozzle means delivers pressurized water through a water ingress defined in a rear wall of the chinaware. This nozzle oscillates the water back and forth to provide full cleaning coverage on the rear wall of the urinal.

The present invention urinal dispenses about or below ¼ gallon of water with every flush, as compared with about ½ gallon to 1 gallon per flush consumed by conventional urinals.

The present invention can assume the aesthetic appearance and size of conventional urinals so that the invention is readily installed in existing commercial or residential bathrooms. The present invention can therefore also coexist alongside conventional urinals or completely replace such urinals without changing the number of urinals or the layout of the entire bathroom.

Various other advantages and features of the present invention will become readily apparent from the following detailed description, and the inventive features will be particularly evident from the appended claims.

DETAILED DESCRIPTION OF THE PREFERRED EMBODIMENTS

Figure 1:
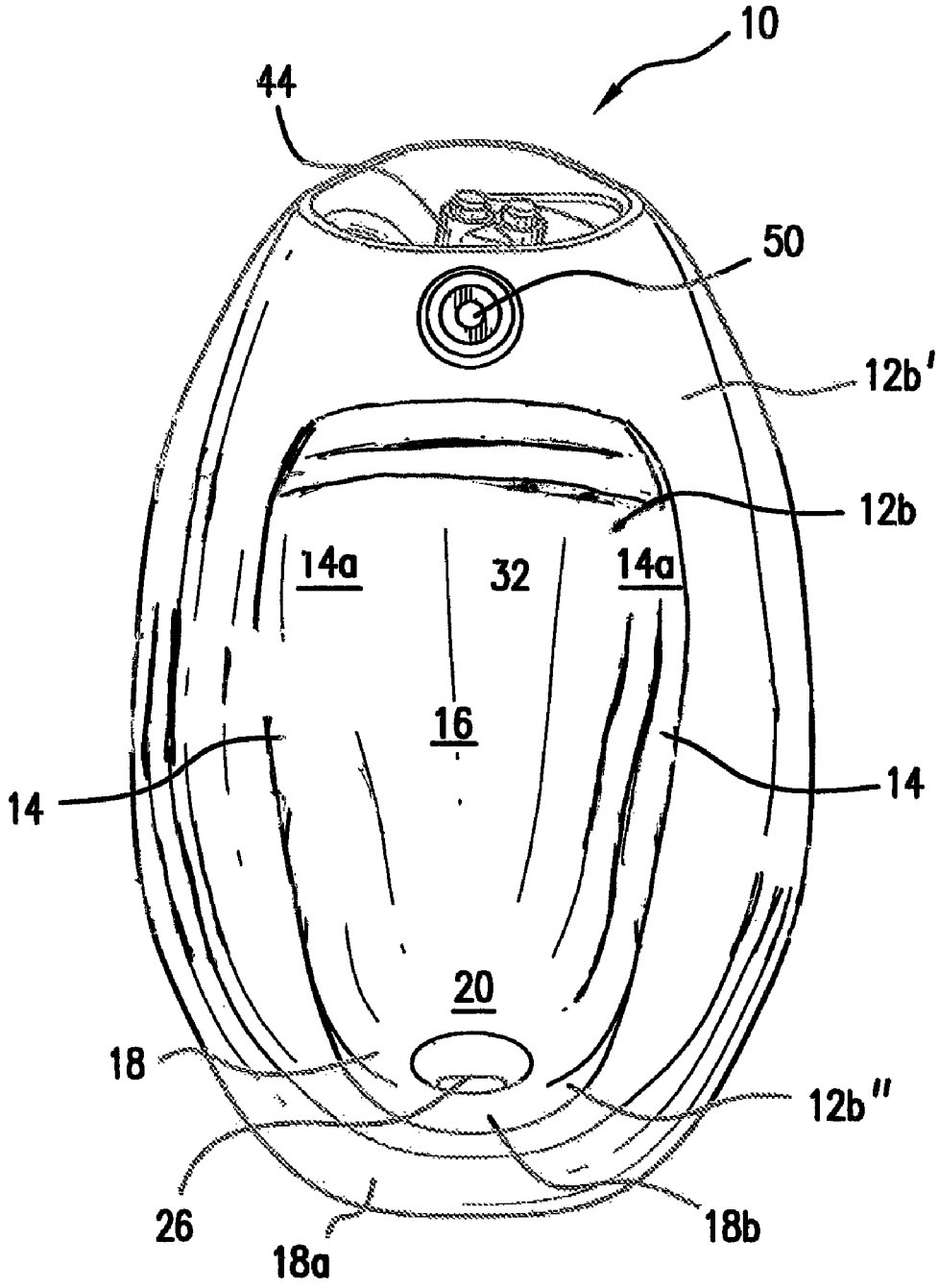
FIG. 1 shows a front view of a microflush urinal of the present invention having nozzle and sensor means incorporated therewith.

Now referring to the figures, wherein like numerals identify like elements, and particularly referring to FIG. 1, a urinal 10 of the present invention desirably comprises an integral chinaware fixture. Urinal 10 may alternatively be fabricated from plastic, stainless steel or any other material that is amenable to practice of the present invention. Any of the materials selected to form urinal 10 may have one or more treatments applied thereon to enhance the urinal's performance. Such treatments may include coatings, glazes and/or additives having one or more of hydrophobic, hydrophilic, antimicrobial, antibacterial, biocidal, odor suppressing, anti-viral and algicidal properties (including, but not limited to, zinc; zinc oxide; gold; cadmium; palladium; silver and silver salts; copper and copper salts; antimony; copper sulfate; mercury; aluminum; platinum; 2,4,4'-trichloro-2-hydroxy diphenol ether and 5-chloro 2 phenol (2,4 dichlorophenoxy) compounds; and U.V inhibitors). Such coatings are well known within the industry to promote the cleanliness of plumbing fixtures and to deter the transmission of undesirable contagions.

Figure 2:
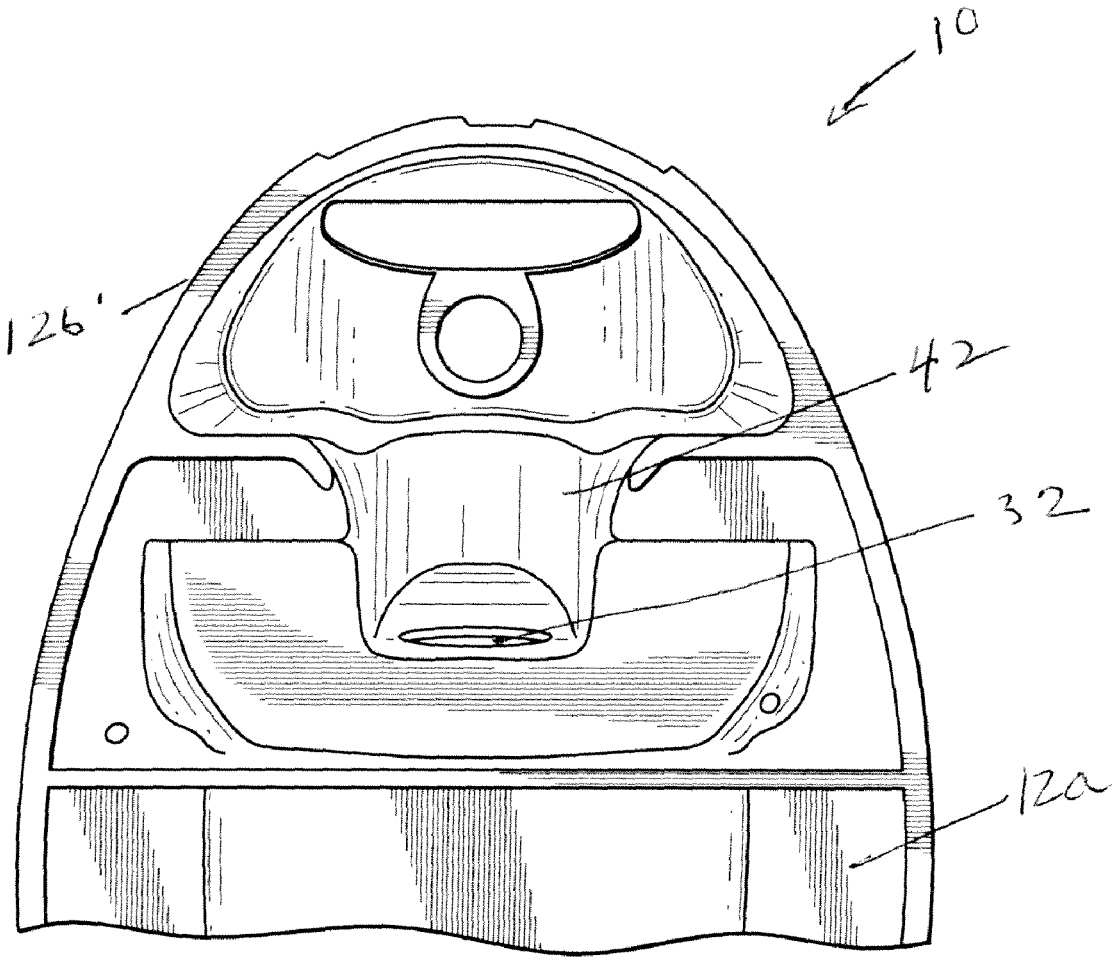
FIG. 2 shows a rear sectional view of the microflush urinal of FIG. 1.

Urinal 10 includes a rear wall 12 having a mounting surface 12*a* for mounting of the urinal to a support structure such as a wall (see FIG. 2), and a urinal surface 12*b* facing the user that serves as a splash surface for the urinal. Urinal surface 12*b* is delineated by an upper extent 12*b*' and a lower extent 12*b*" of rear wall 12, wherein upper extent 12*b*' accommodates ingress of a pre-existing water supply conduit thereto, and lower extent 12*b*" accommodates egress of a new or pre-existing waste conduit therefrom. Lower extent 12*b*" may further accommodate an outlet adapter (not shown) to ensure proper fluid communication between urinal 10 and the waste conduit as is well known in the art. Urinal 10 is readily installed in fluid communication with preexisting plumbing structure, and is therefore amenable to use with a plurality of pre-existing installation configurations within residential and commercial structures.

Urinal 10 further includes two coextensive sidewalls 14 that protrude outwardly from urinal surface 12*b*. Each sidewall 14 has a generally curvilinear inner surface 14*a* that faces a like inner surface 14*a* spaced therefrom. Urinal surface 14 and inner surfaces 14*a* together delineate an interior waste capture region 16. Sidewalls 14 extend along the length of rear wall 12 from upper extent 12*b*' and terminate at floor portion 18. Floor portion 18 has an outer surface 18*a* and an inner surface 18*b* defining a fluid well 20 therewithin. Fluid escapes through a drain 26 disposed at fluid well 20 for evacuation through the waste conduit. A strainer device (not shown) is electively disposed in or adjacent drain 26 to retain larger effluents and thereby prevent occlusion of the waste conduit.

Figure 3:
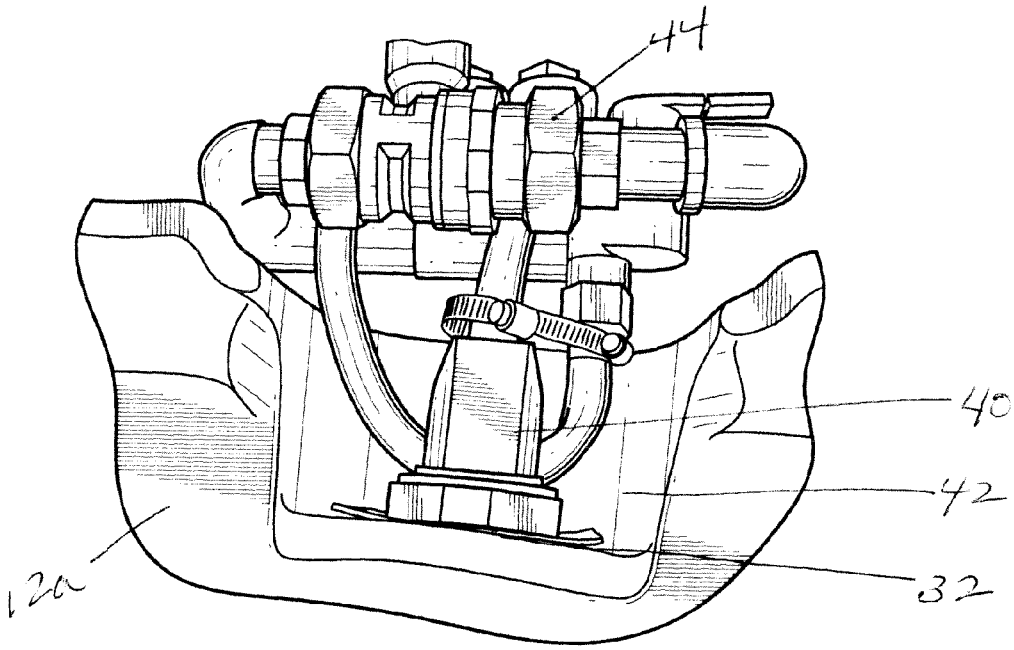
FIG. 3 shows a further section from FIG. 2 wherein a nozzle and fluid manifold are provided.

To achieve sufficient water delivery through ingress 32, urinal 10 desirably employs a nozzle means 40 housed in a containment region 42 of upper extent 12*b*' (see FIG. 3). Nozzle means 40 is provided in fluid communication with a fluid inlet supply such as manifold 44 shown in FIG. 2. Nozzle means 40 is selected from a plurality of known fluid delivery devices and is desirably selected from a plurality of fluidic nozzles, which are well known in the art to use the energy of a supplied fluid for oscillation of the exiting fluid stream. This is accomplished without moving parts using only engineered geometry in the fluid passages. Geometry changes can adjust the oscillating jet's pattern to adjust spray fan width, thickness, and aim. Several such fluidic nozzles are disclosed by the art, including but not limited to the configurations disclosed by U.S. Pat. No. 5,845,845 ("Fluidic Circuit with Attached Cover and Method"), U.S. Pat. No. 6,186,409 ("Nozzles with Integrated or Built-In Filters and Method"), U.S. Pat. No. 6,253,782 ("Feedback-Free Fluidic Oscillator and Method"), U.S. Pat. No. 6,457,658 ("Two-Level Nozzles with Integrated or Built-In Filters and Method"), U.S. Pat. No. 6,978,951 ("Reversing Chamber Oscillator") and US Patent Publication No. 2005/0087633 ("Three-Jet Island Fluidic Oscillator")(all of which are owned by Bowles Fluidics Corporation, co-owner of the present application, and the disclosures of which are incorporated by reference herein in their entireties). Such fluidic nozzles successfully achieve optimum cleanliness due to the delivery of minimal amounts of fluid (via oscillating sprays) to a large surface area. Uniform cleaning is therefore achieved by virtue of the nozzle's fluid distribution without sacrificing precious potable water resources.

A sensor means 50 is provided in electrical communication with nozzle means 40 to effect predictable and repeatable activation of the nozzle means. Sensor means 50 is desirably an infrared sensor that is well known in the art for touchless operation of fixtures and fittings, although sensor means 50 may alternatively comprise radar, laser or other detection means that are amenable to practice of the present invention. Any number of sensors may be used, including the sensor configuration disclosed by US Patent Publication No. 2005/0119764 for a suite of configurable products (assigned to Celec Conception Electronique En Abrege Celec and incorporated by reference herein).

Upon detection of a user, sensor means 50 initiates a flush cycle by generating and transmitting a first signal to the valve means (not shown). Sensor means 50 may generate this signal after a predetermined temporal duration, upon detecting a user within a predetermined distance of urinal 10, upon absence of a user after a predetermined time or any other parameter consistent with flushing the urinal after each use. It is understood that an installer or maintenance professional advantageously programs sensor means 50 to activate the valve means in accordance with predetermined parameters that accommodate the demands of the installation. For installations where anticipated demand will be consistently high (for example, an airport), the valve means can be programmed to activate at consistent time intervals or after a predetermined number of users. For installations where anticipated demand is stable and is limited to certain hours of the day (for example, an office restroom), the valve means can be programmed to activate every other hour during the period of demand and further programmed to refrain from flushing during night hours when no demand is expected.

Upon receipt of the sensor-generated signal, the valve means discharges water via manifold 44 to nozzle means 40 that is in fluid communication with urinal surface 12*b*. Water travels from nozzle means 40 through ingress 32. The oscillating spray generated by nozzle means 40 ensures fluid delivery along rear wall 12 to sidewalls 14 and along the extent of urinal surface 12*b* so as to fully cleanse waste from the entire surface area thereof. Water travels along sidewalls 14 to drain 26 for egress from the urinal, thereby removing urine and water and obviating the need to replenish a trap seal as required by conventional urinal designs.

The present invention employs principles of fluid dynamics and mechanical design to overcome the deficiencies of conventional low-water and waterless urinals. The nozzle of the present inventive urinal evenly distributes water along the urinal's inside urinal surface. A single nozzle with an oscillating jet can be incorporated into the urinal with the following advantages:

The nozzle can be easily mounted through a simple hole in the urinal body. This reduces urinal manifold and the construction complexity.

The nozzle can provide uniform coverage or an engineered fluid distribution from a single nozzle.

The spray can be curved rather than planar. If appropriately designed, the curved spray can match the spray distribution to the concave inner surfaces of the urinal thus creating improved distribution. With only a single nozzle, the curved spray can be used to distribute water to the rear and sides of the urinal Water ligament or sheet breakup and droplet size can be controlled to prevent any undesirable "mist" or fine cloud of droplets escaping the urinal when flushed.

Water exit velocity can be matched to line pressure to achieve the benefit of pressurized cleaning without undesirable ricochet or splatter escaping the urinal when flushed.

By selecting an appropriate nozzle location and controlling ligament or sheet breakup, droplet size, and exit velocity as mentioned above, the urinal cleaned with substantially less water than current technology. This water savings is a tremendous benefit over the life of the urinal.

The combination of effective water application and surface area design reduces the urinal's water consumption without sacrificing odor reduction and a clean appearance. The water exchange function fully discharges the liquid waste of each user after every cycle and presents the next user with clean water. Therefore, urinals configured as described herein provide for satisfactory urinal cleanliness with minimal water usage.

Various changes to the foregoing described and shown structures are now evident to those skilled in the art. The matter set forth in the foregoing description and accompanying drawings is therefore offered by way of illustration only and not as a limitation.

What is claimed is:

1. A microflush urinal, comprising:

a urinal housing in fluid communication with each of a pre-existing cleansing fluid supply conduit and a waste removal conduit, said housing including a rear wall having a mounting surface and an opposed splash surface and sidewalls coextensive therewith, each said sidewall having a curvilinear inner surface wherein said splash surface and said inner sidewall surfaces together delineate a waste capture region;

said housing further having a floor portion at a distal extent of said sidewalls, said floor portion having an outer surface and an inner surface that define a fluid well therewithin; and a valve means in electrical communication with each of a sensor means and a fluid delivery manifold, wherein said fluid delivery manifold directs water or cleansing fluid to a nozzle means in fluid communication therewith upon activation of said sensor means; said nozzle means being disposed in said urinal housing in an upper containment region above said waste capture region and being in fluid communication with said fluid inlet supply when, in response to said activation, said sensor means transmits a first flush cycle signal to said valve means and sprays a flush of ¼ gallon or less via said nozzle means, and wherein said nozzle means includes at least one fluidic oscillator configured to evenly distribute cleansing fluid in an oscillating spray from said upper containment region, said oscillating spray distributing fluid to fully cleanse said urinal rear wall splash surface and said coextensive sidewalls and, with each activation or flush, fully discharge each user's urine or waste.

2. The microflush urinal of claim 1, wherein said at least one fluidic oscillator is selected from feedback reversing chamber or multiple power nozzle types and delivers either a curved or planar oscillating spray onto said urinal's rear wall splash surface.

3. The microflush urinal of claim 1, wherein said sensor means comprises at least one of infrared, radar, laser and like detection means.

4. The microflush urinal according to claim 1, wherein said rear wall has an upper extent proximate said upper containment region that accommodates said pre-existing cleansing fluid supply conduit therein and a lower extent proximate said waste capture region that accommodates egress of said pre-existing waste conduit therefrom.

5. The microflush urinal according to claim 1, wherein said urinal housing is fabricated from a material selected from porcelain, ceramic, plastic, and metal and combinations thereof.

6. The microflush urinal according to claim 1, wherein at least a portion of said urinal housing has one or more treatments applied thereon, said treatments being selected from coatings or glazes having one or more of hydrophobic, hydrophilic, anti-microbial, antibacterial, biocidal, odor suppressing, anti-viral and algicidal properties.

7. The microflush urinal according to claim 1, wherein said valve means comprises at least one solenoid valve having at least one fluid discharge port provided therewith.

8. The microflush urinal according to claim 1, wherein said sensor means generates at least one signal in response to at least one predefined parameter such that said fluid delivery means discharges water to said nozzle means in response thereto.

9. The microflush urinal according to claim 8, wherein said at least one predefined parameter is selected from the passage of a predetermined temporal duration, use of said urinal by a predetermined number of users, absence of users for a predetermined temporal duration, detection of a user within a predetermined distance of said urinal and any combination thereof.

10. The microflush urinal according to claim 8, wherein said sensor means is programmable by an installer or by a maintenance professional.

11. The microflush urinal according to claim 10, wherein said sensor means is programmable to permit adjustment of at least one parameter selected from the following flush parameters:

passage of a predetermined temporal duration from a prior flush, use of said urinal by a predetermined number of sensed users, absence of sensed users for a predetermined temporal duration, and detection of a sensed user within a predetermined distance of said urinal.

12. A urinal configured to conserve water resources, comprising:

a urinal housing adapted for connection with a pre-existing cleansing fluid supply conduit and a waste removal conduit, said housing including a rear mounting surface opposite a splash surface and laterally opposed sidewalls coextensive with said splash surface, each said sidewall having a curvilinear inner surface wherein said splash surface and said inner sidewall surfaces together define a waste capture region;

said housing further having a floor portion at a distal extent of said sidewalls, said floor portion having an outer surface and an inner surface that define a fluid well therewithin; and a cleansing fluid flow control valve configured to respond to a first timer or sensor activation signal;

a cleansing fluid delivery manifold including a nozzle, wherein said fluid delivery manifold directs cleansing fluid to the nozzle in response to said first activation signal;

said nozzle being disposed in said urinal housing in an upper or proximal containment region above said waste capture region and being in fluid communication with said cleansing fluid supply such that, in response to said first activation signal, said activation comprises a first flush cycle signal transmitted to said valve and in response said nozzle sprays a flush of ¼ gallon or less, and wherein said nozzle includes at least one fluidic oscillator configured to evenly distribute cleansing fluid in an oscillating spray from said upper containment region, said oscillating spray distributing fluid to fully cleanse said urinal housing's splash surface and said coextensive sidewalls and, with each activation or flush, fully discharge each user's urine or waste.

13. The urinal of claim 12, wherein said at least one fluidic oscillator is selected from feedback reversing chamber or multiple power nozzle types and delivers either a curved or planar oscillating spray onto said urinal's splash surface.

14. The urinal of claim 12, wherein said urinal includes a sensor configured to touchlessly detect a user and generate said first activation signal in response thereto.

15. The urinal of claim 14, wherein said urinal sensor comprises at least one tombless sensor configured to detect infrared, radar, or laser touchless detection signals.

16. The urinal of claim 12, wherein said urinal includes a timer configured or programmed to generate said first activation signal in response to predetermined valve actuation parameters responsive to anticipated demand.

17. The urinal of claim 16, wherein said urinal timer is configured or programmed to generate said first activation signal at consistent time intervals.

* * * * *